US005930894A

United States Patent [19]

Oikawa et al.

[11] Patent Number: 5,930,894

[45] **Date of Patent: *Aug. 3, 1999**

[54] METHOD FOR MANUFACTURING HEAT EXCHANGERS

[75] Inventors: Rei Oikawa, Isesaki; Yukihiro Fukada, Ohota, both of Japan

[73] Assignee: Sanden Corporation, Gunma, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/855,453

[22] Filed: May 13, 1997

Related U.S. Application Data

[63] Continuation of application No. 08/596,404, Feb. 2, 1996, Pat. No. 5,718,285.

[30] Foreign Application Priority Data

Feb. 7, 1995 [JP] Japan ..... 7-19027

[51] Int. Cl.[6] ..... B23P 15/26

[52] U.S. Cl. ..... 29/890.047; 29/890.054

[58] Field of Search ..... 29/890.047, 890.03, 29/890.054; 165/153, 176

[56] References Cited

U.S. PATENT DOCUMENTS

| | | |
|---|---|---|
| 1,286,433 | 12/1918 | Singer . |
| 2,999,308 | 9/1961 | Pauls . |
| 4,974,670 | 12/1990 | Noguchi . |
| 5,062,477 | 11/1991 | Kadle . |
| 5,088,193 | 2/1992 | Okada et al. . |
| 5,176,206 | 1/1993 | Nagasaka et al. . |
| 5,211,222 | 5/1993 | Shinmura . |
| 5,318,114 | 6/1994 | Sasaki . |
| 5,411,079 | 5/1995 | Sasaki et al. . |
| 5,494,099 | 2/1996 | Chiba et al. . |
| 5,513,432 | 5/1996 | Sasaki et al. . |
| 5,632,331 | 5/1997 | Shinmura . |
| 5,647,433 | 7/1997 | Sasaki . |

FOREIGN PATENT DOCUMENTS

| | | | |
|---|---|---|---|
| 0646759 | 4/1995 | European Pat. Off. . | |
| 2706003 | 8/1977 | Germany . | |
| 3803599 | 8/1989 | Germany . | |
| 1249261 | 10/1989 | Japan . | |
| 2106697 | 4/1990 | Japan | 165/153 |
| 3221789 | 9/1991 | Japan | 165/153 |
| 420794 | 1/1992 | Japan . | |
| 719785 | 1/1995 | Japan . | |

*Primary Examiner*—Irene Cuda
*Attorney, Agent, or Firm*—Baker & Botts, LLP

[57] ABSTRACT

A laminated-type evaporator for an automotive air conditioning refrigerant circuit includes a plurality of tube units having a pair of tray-shaped plates. Each of the tray-shaped plates includes a depression defined therein, a flange extending about the periphery thereof, and a wall disposed at an intermediate location therein and extending a portion of the length of each plate to thereby define a rear side and a front side to each plate. The wall includes a flat portion formed at an upper end thereof. A slit is formed at the flat, upper end portion of the wall by shearing. The slit extends along substantially the entire length of the wall along the wall's longitudinal axis.

6 Claims, 13 Drawing Sheets

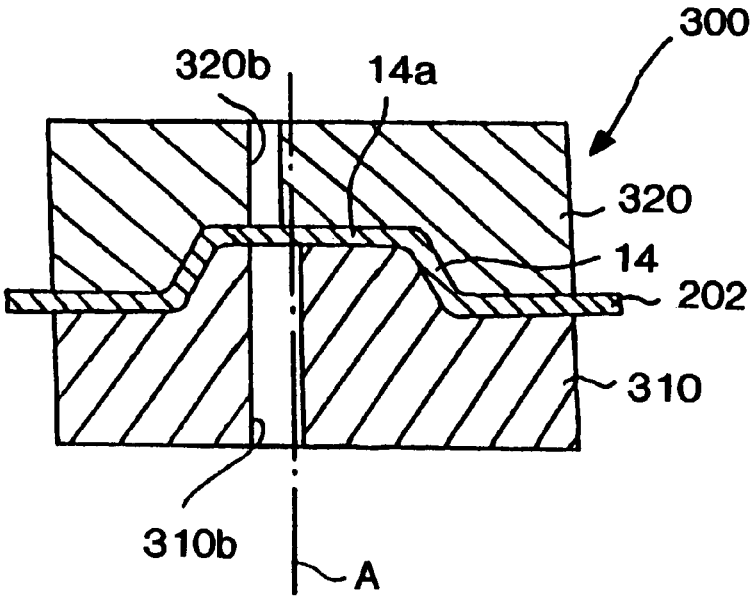
FIG. 8B-2
FIG. 8G-2
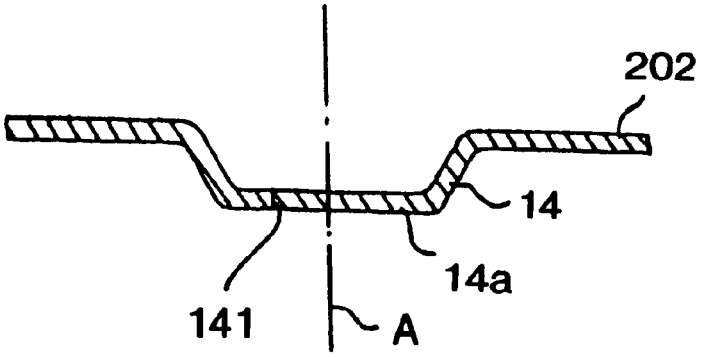

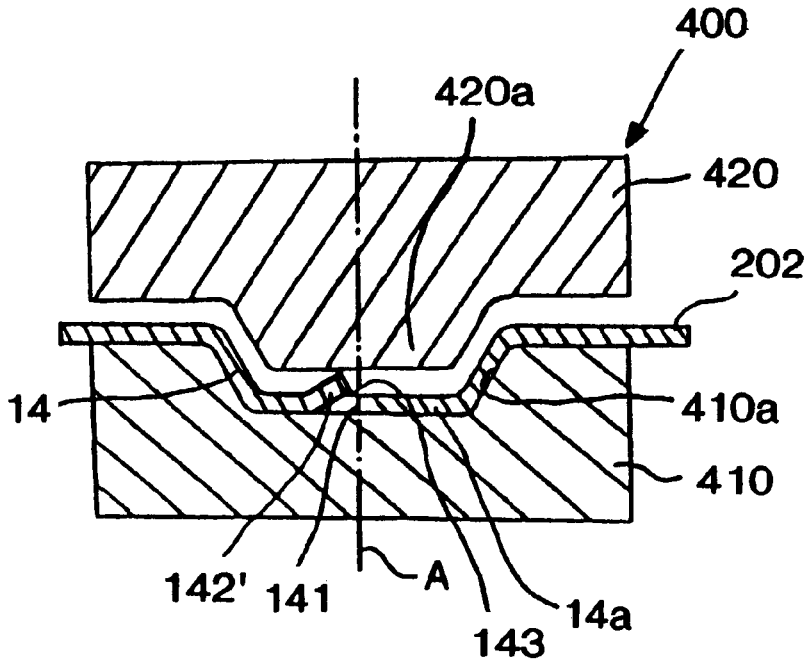
FIG. 8F-2
FIG. 8G-3
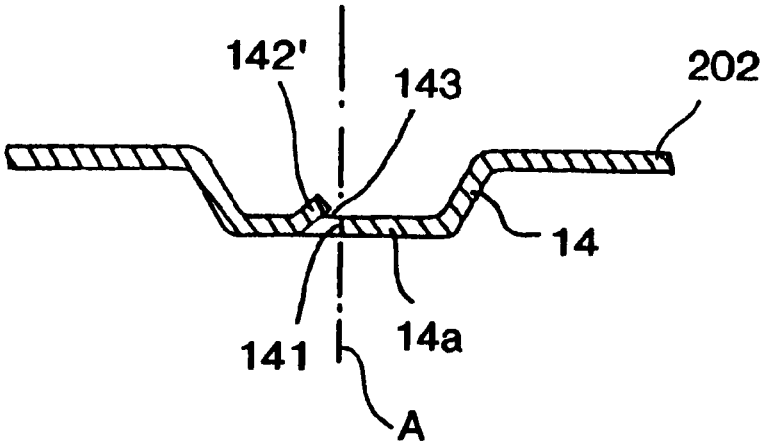

METHOD FOR MANUFACTURING HEAT EXCHANGERS

This application is a continuation of application Ser. No. 08/596,404, filed Feb. 2, 1996 entitled HEAT EXCHANGER AND METHOD FOR MANUFACTURING HEAT EXCHANGER, now U.S. Pat. No. 5,718,285.

BACKGROUND OF THE INVENTION

1. Technical Field of the Invention

This invention relates generally to heat exchangers for refrigerant circuits, and more particularly, to the heat exchange medium conducting elements which form a heat exchanging area of such heat exchangers.

2. Description of the Prior Art

Various types of heat exchangers are known in the prior art. For example, European Patent No. 0646759 A1, which is incorporated herein by reference, describes a laminated-type heat exchanger used in an evaporator of an automotive air conditioning refrigerant circuit, as shown in FIGS. 1–4. With reference to FIGS. 1–4, laminated-type evaporator 200 includes a plurality of tube units 201 of aluminum alloy that function as the heat exchange medium conducting elements and form a heat exchanging area 200*a* together with corrugated fins 20. Each of tube units 201 has a pair of tray-shaped plates 202 of a clad construction, whereby a brazing metal sheet is formed on a core metal.

Laminated-type evaporator 200 further includes a pair of parallel, closed-ended cylindrical pipes 230 and 240 positioned above the upper surface of laminated tube units 201. As shown in FIG. 2, cylindrical pipe 230 is positioned forward of cylindrical pipe 240 (to the right in FIG. 2). A plurality of substantially oval-shaped slots 231 are formed along the lower, curved surface of cylindrical pipe 230 at equal intervals. A plurality of substantially oval-shaped slots 241 also are formed along the lower, curved surface of cylindrical pipe 240 at equal intervals. Oval-shaped slots 231 of pipe 230 are aligned in parallel with substantially oval-shaped slots 241 of pipe 240, so as to receive a pair of tapered, hollow connecting portions 203*b* of tube units 201, which are described in detail below.

As illustrated in FIGS. 3A and 3B, each of tray-shaped plates 202 of tube unit 201 includes a depression 120 formed therein, a flange 13 formed around the periphery thereof, and wall 14 formed in the central region thereof. Wall 14 extends downwardly from an upper end of plate 202 and terminates about one-seventh of the length of plate 202 from the lower end thereof. Wall 14 includes a flat, top end portion 14*a*. A plurality of rectangular-shaped openings 14*b*, for example, five of such openings, as depicted in FIG. 3, are formed by punching at the flat, top end portion 14*a* of wall 14 along the length of wall 14 after the tray-shaped plate 202 is formed by press work.

Each of tray-shaped plates 202 has a pair of tapered, connecting tongues 203 projecting upwardly from the upper end thereof. One of the tongues 203 is disposed to the right of narrow wall 14, and the other tongue 203 is disposed to the left thereof A depression 203*a* is formed in the central region of tongue 203, and extends longitudinally from the upper end to the lower end thereof. Depression 203*a* is linked to depression 120 of plate 202. The bottom surface of depression 203*a* adjoins the plane of the inner bottom surface of depression 120.

With reference to FIGS. 3A–3B and 4, a plurality of annular cylindrical projections 16 and 17 project from the inner bottom surface of depression 120 and the bottom surface of depression 203*a*. Cylindrical projections 16 and 17 are formed, for example, by burring. Cylindrical projections 16 are located in depression 120 and depression 203*a* on the right side, i.e., forward, of wall 14, and cylindrical projections 17 are located on the left side, i.e., rearward, thereof. Cylindrical projections 16 are laterally aligned with one another at regular intervals in a plurality of rows. The rows of cylindrical projections 16 are arranged at regular intervals, but adjacent rows of cylindrical projections 16 are relatively offset from one another by about one half of the length of the interval between projections 16. Alternatively, cylindrical projections 16 may be arranged diagonally at regular intervals in a plurality of parallel, diagonal rows.

The arrangement of cylindrical projections 17 is similar to that of cylindrical projections 16. The arrangement of cylindrical projections 16 and 17 in one of the pair of plates 202 is identical to that in the other of the pair of plates 202, so that the pair of plates 202 may be joined.

Although cylindrical projections 16 and 17 are not depicted in the central region of shallow depression 120 in FIGS. 3A and 3B, cylindrical projections 16 and 17 may extend continuously along the length of shallow depression 120. As depicted in FIG. 4, an inner diameter $D_1$ of each cylindrical projection 16 is greater than an outer diameter $D_2$ of each cylindrical projection 17. In addition, an upper, end surface of each of cylindrical projections 16 and 17 extends over an upper surface of the flat, upper portion 14*a* of wall 14; the flat, upper end surface of each of tongues 203; and the plane of flange 13.

Evaporator 200 is temporarily assembled prior to the next sequential step of brazing in a manufacturing process thereof. When evaporator 200 is temporarily assembled, the pair of plates 202 are joined to each other by mating the plane of flanges 13; the flat, upper end surface of tongues 203; and an upper surface of the flat, upper end portions 14*a* of walls 14. When the pair of plates 202 are joined to each other, the upper end portions of cylindrical projections 17 are received in the upper end portions of the corresponding cylindrical projections 16, as shown in FIG. 4.

When the pair of tray-shaped plates 202 are joined together at flanges 13 so as to form a U-shaped passage 205 therebetween, the pair of tongues 203 of the pair of plates 202 define a pair of tapered, hollow connecting portions 203*b*. Walls 14 of each plate 202 contact one another at the upper surface of the flat, upper end portions 14*a*, thereby aligning the corresponding rectangular-shaped openings 14*b* with one another.

Heat exchanger area 200*a* of evaporator 200 is temporarily assembled by laminating together a plurality of tube units 201 and inserting corrugated fins 20 within intervening spaces 21, which are defined between adjacent tube units 201 by rectangular flanges 18. Rectangular flange 18 projects from the lower end of plate 202. Flange 18 projects downwardly from plate 202 and at substantially a right angle at the terminal end thereof. A pair of side plates 22 are attached to the left side of plate 202*a*, which is located on the rearward side of evaporator 200, and the right side of the plate 202*b*, which is located on the forward side of evaporator 200, respectively. Corrugated fins 20 are inserted within intervening spaces 21, which are defined between side plate 22 and plate 202*a*, and between side plate 22 and plate 202*b*, respectively, by means of rectangular flanges 22*a*. Rectangular flanges 22*a* project from the lower end of side plates 22 and are bent downwardly at substantially a right angle at the terminal end thereof. Although corrugated fins 20 are only depicted in FIG. 1 at the upper and lower ends of intervening spaces 21, corrugated fins 20 may extend continuously along the entire length of intervening spaces 21.

The pair of tapered, hollow connecting portions 203*b* of tube units 201 are inserted into slots 231 and 241 until the lower end portions of connecting portions 203*b* contact the inner peripheral surfaces of slots 231 and 241, respectively. Circular partition 234 is disposed at an intermediate location within the interior region of cylindrical pipe 230 so as to divide the cylindrical pipe 230 into a rearward section 230*a* and a forward side section 230*b*, as shown in FIG. 1. Thus, a process of temporarily assembling the evaporator 200 is completed.

After completion of the process of temporarily assembling evaporator 200, temporarily assembled evaporator 200 may be transported from an assembly line to a brazing furnace, so that elements constituting evaporator 200, such as tube units 201, cylindrical pipes 230 and 240, corrugated fins 20, side plates 22, and circular plate 234 may be fixedly connected to one another by means of brazing, for example, in an inert gas, e.g., helium, atmosphere.

In this process of brazing temporarily assembled evaporator 200, the mating surfaces of the pair of plates 202, such as flanges 13; the flat, upper end surface of each of tongues 203; the upper surface of the flat, upper end portion 14*a* of walls 14; and an upper inner and upper outer peripheral surface of the respective cylindrical projections 16 and 17 are brazed to one another, so as to fixedly join the pair of plates 202 to each other. In general, however, before the pair of plates 202 are fixedly joined to each other by brazing, aluminum oxide, which may have formed on the surfaces to be mated, is removed in order to more effectively join the pair of plates 202. For example, the surfaces to be mated are treated with flux to remove the aluminum oxide formed thereon.

According to this prior art embodiment, the flux is dissolved in water and sprayed on the entire exterior surface of the temporarily assembled pair of plates 202. Some of the flux solution applied to the exterior surface of the temporarily assembled pair of plates 202 seeps into small gaps between the mating surfaces of flanges 13 and the flat, upper end surfaces of tongues 203. Some of this flux solution also seeps into small air gaps created between the mating surface of the flat, upper end portion 14*a* of walls 14 through rectangular-shaped openings 14*b*. In addition, some of the flux solution applied to the exterior surface of the temporarily joined pair of plates 202 seeps between small radial air gaps created between an inner peripheral surface of the top end portion of cylindrical projections 16 and an outer peripheral surface of the top end portion of the corresponding cylindrical projections 17.

Thus, the flux solution seeps between substantially all of the mating surfaces of the temporarily assembled pair of plates 202. Therefore, substantially all of the entire mating surfaces of the temporarily joined pair of plates 202 to be brazed are effectively treated by the flux, so that aluminum oxide formed thereon is sufficiently removed before the mating surfaces of the pair of plates 202 are brazed to one another.

In the flux treatment method described above, water sprayed on the exterior surface of temporarily assembled evaporator 200 together with the flux is removed, for example, by natural vaporization, before temporarily assembled evaporator 200 is transported from the assembly line to the furnace in which the brazing process is performed.

According to this prior art heat exchanger, because only the exterior surface of the temporarily joined pair of plates 202 is covered with the flux, no residual flux collects on the inner bottom surface of depression 120 or the bottom surface of depression 203*a*. Therefore, the refrigerant flow path of the automotive air conditioning refrigerant circuit is not impeded by flakes of residual flux.

Moreover, in a separate brazing process, one end of inlet pipe 50 and one end of outlet pipe 60 are fixedly connected to circular openings 232 and 233, respectively, of cylindrical pipe 230 of FIG. 1. Circular openings 232 and 233 are formed at the rear and front end portions of cylindrical pipe 230, respectively, on the leading curved surface thereof. Inlet pipe 50 is provided with a union joint 50*a* at the other end thereof and outlet pipe 60 is similarly provided with a union joint 60*a* at the other end thereof.

As described above, after the operation of the press machine forming the tray-shaped plate 202 is completed, rectangular-shaped openings 14*b* may be formed at the flat, upper end portion 14*a* of wall 14 along the entire length of wall 14 by punching. Small rectangular scraps (not shown) are by products of the punching process. These scraps may interfere with further punching operation.

Specifically, when metal scraps remain on a mold (not shown) of a punching machine (not shown), small projections may form on an aluminum alloy material sheet due to the presence of such scraps on the mold. If the small projections are formed at the flat, upper end portion 14*a* of walls 14; the upper surfaces of flat, upper end portion 14*a* of walls 14 may not be in close contact with each other. As a result, the mating surfaces of walls 14 may not be effectively and sufficiently brazed, so that the inner pressure resistance of tube unit 201 is not be effectively increased. In addition, the presence of the scraps on the mold may cause damage to the mold.

In order to avoid the foregoing problems, a blower is sometimes used to blow away scraps punched from the walls 14 after every operation of the punching machine. However, a punching machine equipped with such a blower is mechanically complicated and expensive, thereby increasing the manufacturing cost of evaporator 200.

SUMMARY OF THE INVENTION

Accordingly, it is an object of the present invention to provide a heat exchanger having a high inner pressure resistance without incurring increased manufacturing costs.

In order to achieve this and other objects of the present invention, a heat exchanger in accordance with the present invention may comprise a plurality of laminated tube units. Each of the tube units may include a pair of plates joined together to define therebetween a fluid passage and at least one fluid communication opening extending from the pair of plates and linked in fluid communication with the fluid passage. At least one conduit is disposed on upper surfaces of the plurality of laminated tube units. The at least one conduit may include a plurality of slots for receiving the at least one fluid communication opening in the plurality of laminated tube units. Each plate in the pair of plates includes a shallow depression formed therein, a flange extending about the periphery thereof, and a partition disposed at an intermediate location therein and extending a portion of the length of each of the plates. The partition defines a rearward side and a forward side in the plates. The partition includes a flat portion formed at an upper end thereof. A slit is formed at the flat, upper end portion of the partition, for example, by shearing and extends along substantially the entire length of the partition.

The invention further relates to a method for forming such heat exchangers, Such heat exchangers may include a plurality of laminated tube units, each of the tube units including a pair of plates, e.g., a first and a second plate, joined together to define therebetween a fluid passage and at least one fluid communication opening extending from the pair of plates and linked in fluid communication with the fluid passage. At least one conduit is disposed on an upper surface of the plurality of laminated tube units, and the at least one conduit includes a plurality of slots for receiving the at least one fluid communication opening in the plurality of laminated tube units. Each plate in the pair of plates includes a depression formed therein, a peripheral flange, and a wall having a longitudinal axis and disposed at an intermediate location therein and extending a portion of the length of each of the plates. Thus, the wall defines a first side and a second side in the plates, and the wall includes a flat portion formed at an upper end thereof. A slit is formed at the flat, upper end portion of the wall and extends along the wall's length. The method comprises the steps of forming the wall e.g., a first or a second wall, in each of the plates by pressing and forming the slit, e.g., a first or a second slit, in each of the walls by shearing. The method may further comprise the steps of temporarily assembling the pair of plates, so that an upper surface of the flat, upper end portions of the walls of the pair of plates mate with each other; coating an exterior surface of the tube unit with a flux; and brazing the mating surfaces of the flat, upper end portion of the wall of the pair of plates.

Other objects, features, and advantages are understood by persons of ordinary skill in the art by considering the following figures and the accompanying detailed description.

BRIEF DESCRIPTION OF THE DRAWINGS

FIGS. 8A-1 thru 8G-1 depict a portion of the manufacturing process of the evaporator, in accordance with the first embodiment of the present invention.

FIGS. 8B-2 and 8G-2 depict a portion of the manufacturing process of an evaporator, in accordance with a second embodiment of the present invention.

FIGS. 8F-2 and 8G-3 depict a portion of the manufacturing process of an evaporator, in accordance with a third embodiment of the present invention.

FIGS. 8F-3 and 8G-4 depict a portion of the manufacturing process of an evaporator, in accordance with a fourth embodiment of the present invention.

DETAILED DESCRIPTION OF THE PREFERRED EMBODIMENTS

Figure 4:
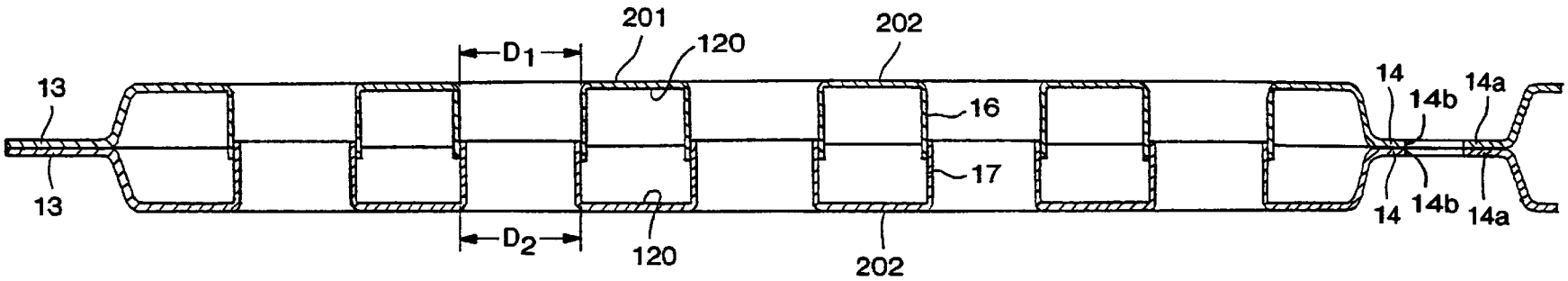
FIG. 4 (PRIOR ART)
FIG. 4 is an enlarged view taken along line IV—IV of FIG. 2.
Figure 5:
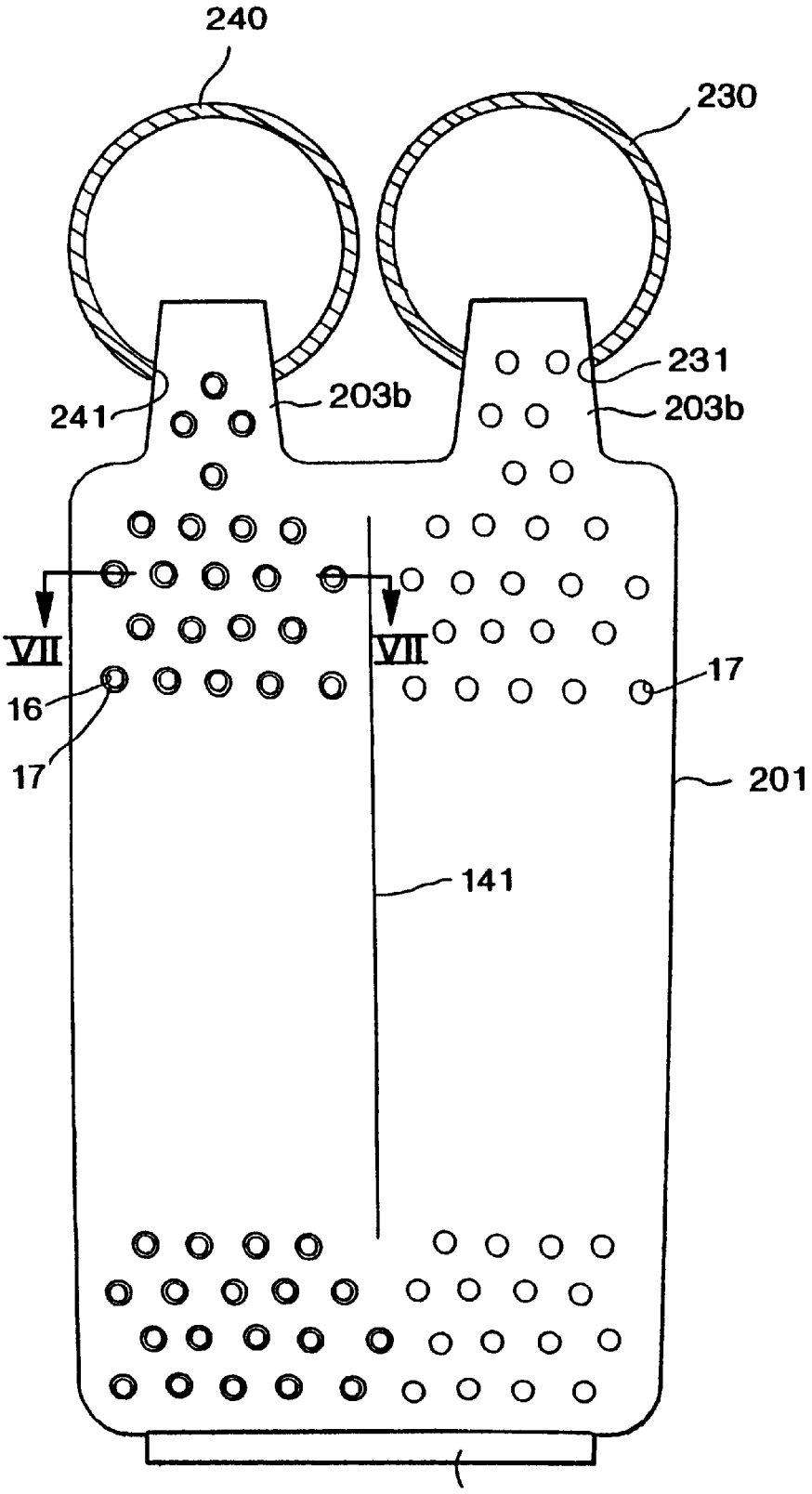
FIG. 5 is an enlarged end view of an assembled tube unit which forms a part of a laminated-type evaporator, in accordance with a first embodiment of the present invention.
Figure 6B:
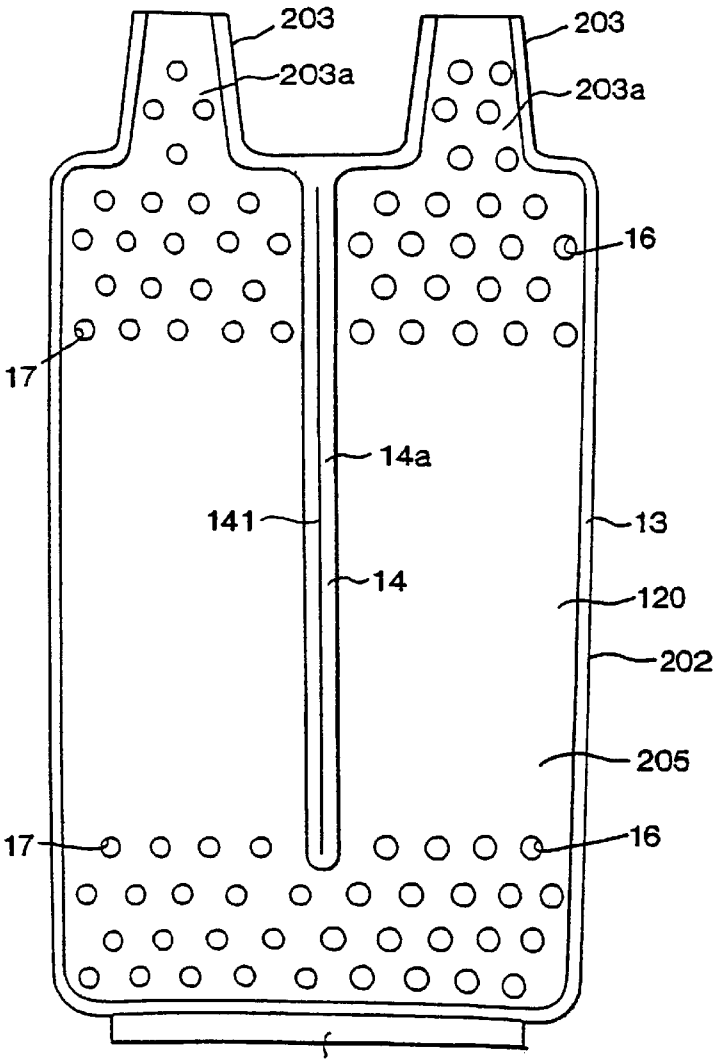
FIGS. 6A and 6B show the tube unit of FIG. 5 unassembled.
Figure 6A:
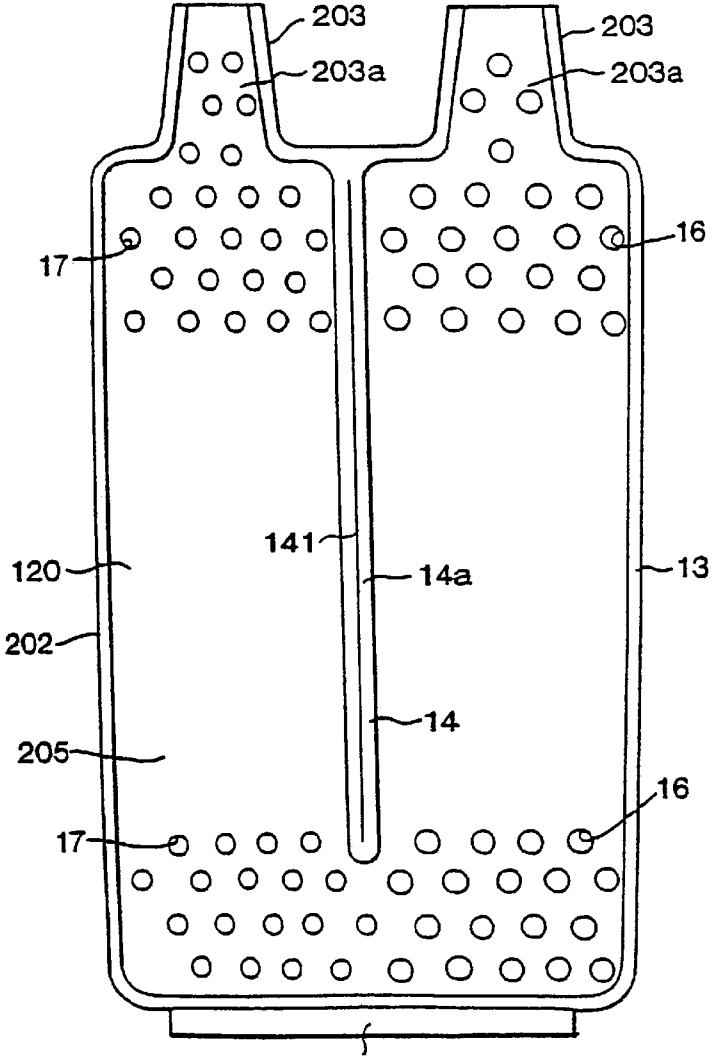
Figure 7:
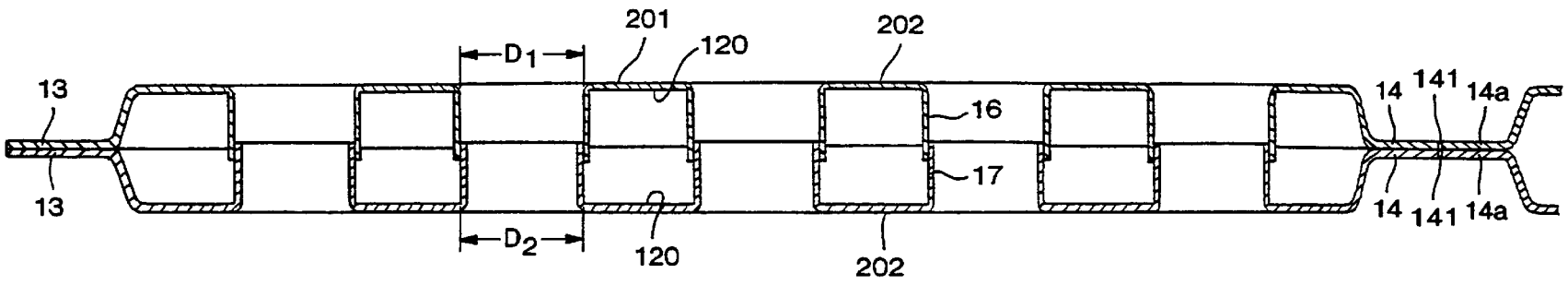
FIG. 7 is an enlarged view taken on line VII—VII of FIG. 5.

FIGS. 5–7 depict a tube unit of a laminated-type heat exchanger used for an evaporator of an automotive air conditioning refrigerant circuit in accordance with a first embodiment of the present invention. In the drawings, like reference numerals are used to denote elements corresponding to these shown in FIGS. 1–4, so that a further explanation thereof is here omitted.

With reference to FIGS. 5–7, a slit 141 is formed at the flat, upper end portion 14*a* of wall 14 of the tray-shaped plate 202 along a longitudinal axis of wall 14, e.g., by a shearing operation, after formation of the tray-shaped plate 202 by press work. Slit 141 extends continuously along substantially the entire length of wall 14.

In a manufacturing process of evaporator 200 of the first embodiment, temporarily joined tube unit 201 may be prepared by the following sequential steps:

(1) In a first step, the tray-shaped plate 202 is formed from a rectangular aluminum or aluminum alloy sheet (not shown) for example, by press work, in which depression 120, flange 13, wall 14, the pair of connecting tongues 203, and rectangular flange 18 are simultaneously formed.

(2) In a second step, slit 141 is formed at flat, upper end portion 14*a* of wall 14 of tray-shaped plate 202. This second step of process of forming slit 141 is described in detail below with reference to FIGS. 8A-1 thru 8G-1.

Figure 9:
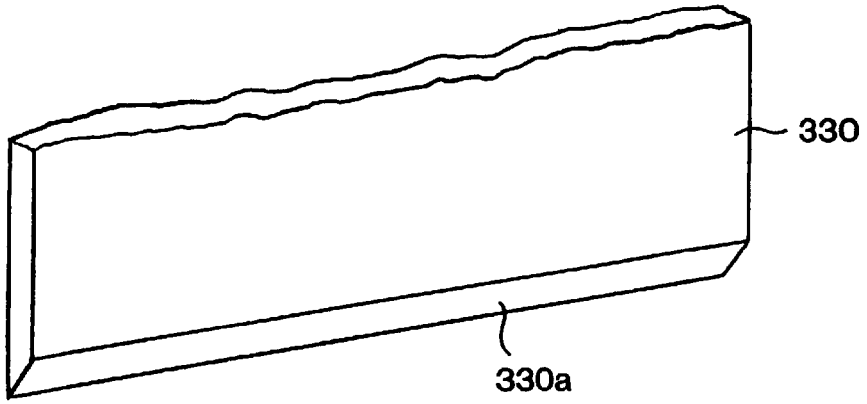
FIG. 9 is an enlarged, partial perspective view of an upper blade of the shearing machine shown in FIGS. 8C-1 and 8D-1.

First, tray-shaped plate 202 processed in the above step (1) is moved to a shearing machine 300 which includes a lower stationary mold 310, an upper movable mold 320, and a movable rectangular plate 330, as shown in FIG. 9.

Lower stationary mold 310 includes projection 310*a* formed on an upper surface thereof. Upper movable mold 320 includes an indentation 320*a* formed on a lower surface thereof Projection 310*a* of lower stationary mold 310 is shaped to be in close contact with a lower surface (toward the bottom in FIG. 8A-1) of wall 14. Indentation 320*a* of upper movable mold 320 is shaped to be in close contact with an upper surface (toward the top in FIG. 8A-1) of wall 14. Movable rectangular plate 330 includes blade portion 330*a* formed at a lower end thereof. Blade portion 330*a* is formed by inclining a lower end of one side surface (to the right in FIG. 8A-1) of rectangular plate 330 and functions as an upper blade of shearing machine 300. A hole 320*b* having a rectangular cross-section is formed through upper movable mold 320, so that movable rectangular plate 330 may slidably penetrate therethrough. A hole 310*b* also having a rectangular cross-section is formed through lower stationary mold 310 so as to receive blade portion 330*a* of movable rectangular plate 330 therein. An upper edge of one long side wall (to the left in FIG. 8A-1) of hole 310*b* of lower stationary mold 310 functions as a lower blade of shearing machine 300. A width $W_1$ of hole 310*b* of lower stationary mold 310 is greater than a width $W_2$ of hole 320*b* of upper movable mold 320 by an amount which is substantially equal to a thickness of flat, upper end portion 14*a* of wall 14 of tray-shaped plate 202.

Figure 1:
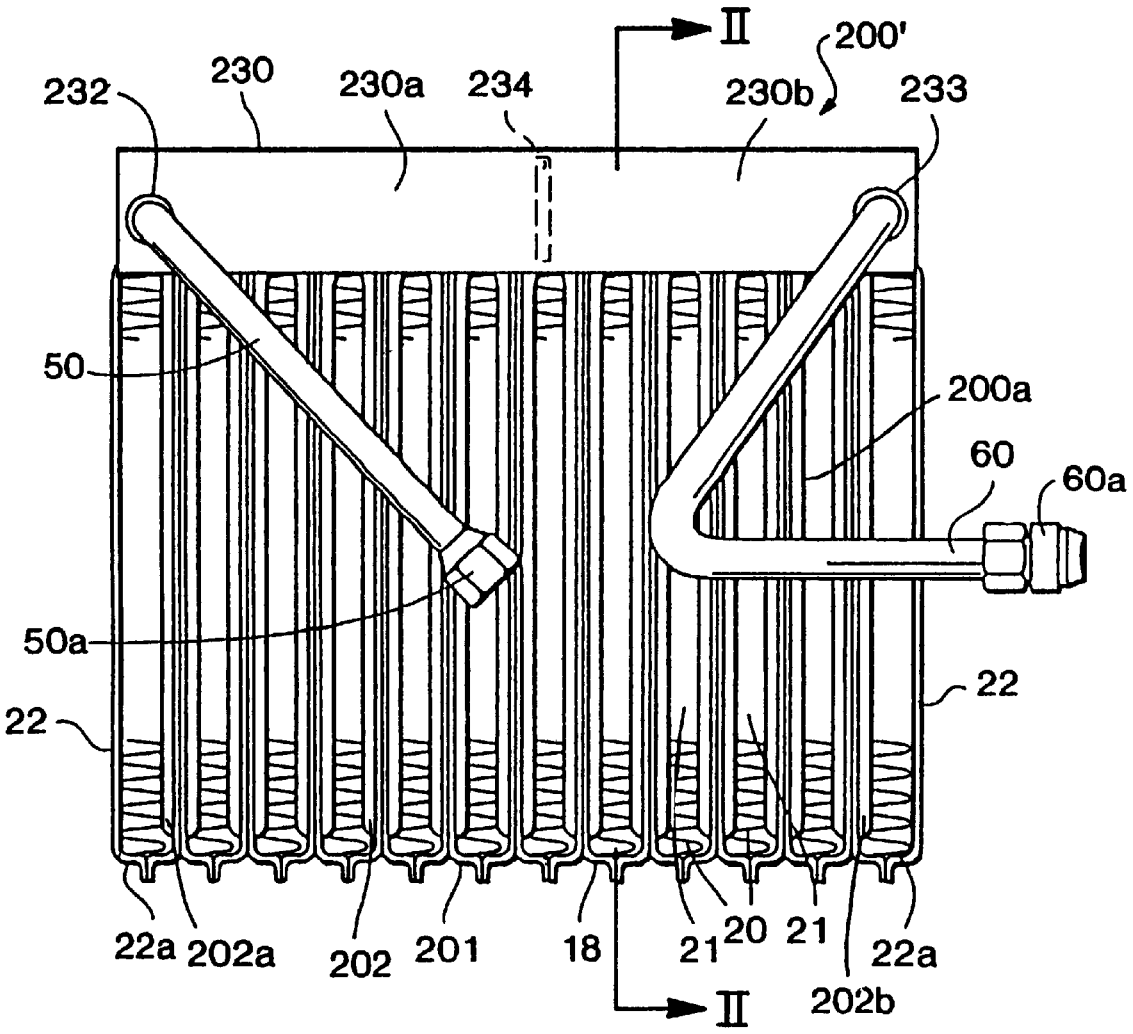
FIG. 1 (PRIOR ART)
FIG. 1 is a front view of a laminated-type evaporator in accordance with the prior art.
Figure 8A:
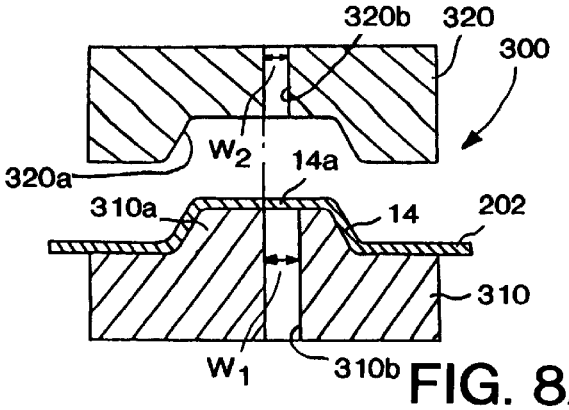

In this step, as depicted in FIG. 8A-1, tray-shaped plate 202 is placed on lower stationary mold 310, such that wall 14 is closely received on projection 310*a* of lower stationary mold 310.

Figure 8E:
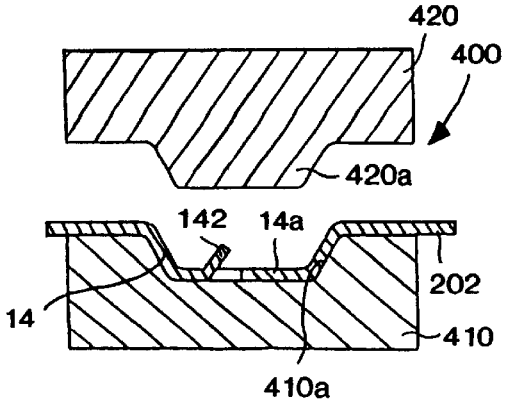
Figures 1, 8B:
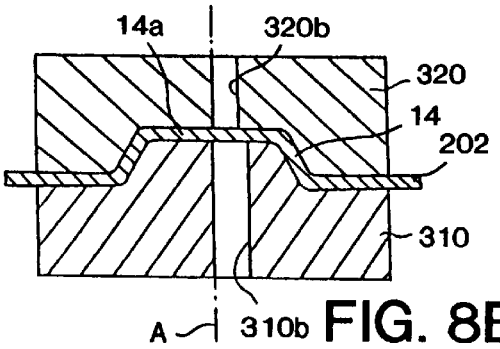

As depicted in FIG. 8B-1, wall 14 of tray-shaped plate 202 then is sandwiched between lower stationary mold 310 and upper movable mold 320. In this situation, upper movable mold 320 and lower stationary mold 310 are aligned, such that holes 320*b* and 310*b* oppose each other through flat, upper end portion 14*a* of wall 14 and such that molds 320 and 310 extend along substantially the entire length of wall 14. Upper movable mold 320 and lower stationary mold 310 are further arranged, such that one side wall (to the left in FIG. 8B-1) of hole 320*b* and one side wall (to the left in FIG. 8B-1) of hole 310*b* are aligned with plane "A," which includes the longitudinal axis of wall 14 and is perpendicular to flat, upper end portion 14*a* of wall 14.

Figures 1, 8F:
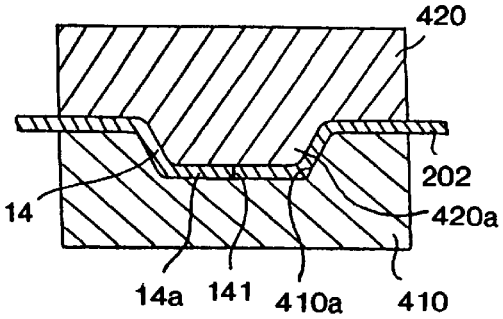
Figure 8C:
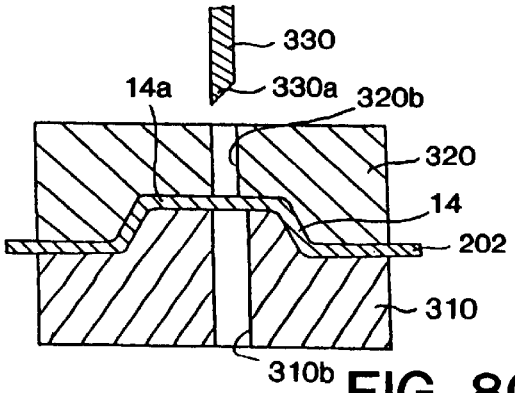
Figures 1, 8G:
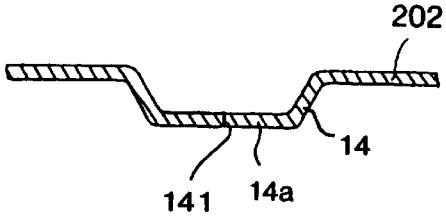
Figure 8D:
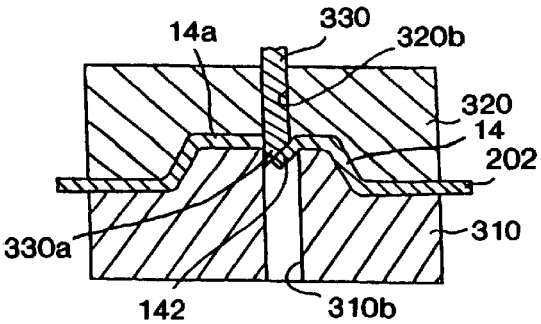

As depicted in FIGS. 8C-1 and 8D-1, the flat top end portion 14*a* of wall 14 of tray-shaped plate 202 is sheared along the longitudinal axis of wall 14 by moving the movable rectangular plate 330 downwardly through hole 320*b* of upper movable mold 320. The downward movement of movable rectangular plate 330 is terminates when blade portion 330*a* is received in an upper end portion of hole 310*b* of lower stationary mold 310. Thus, as depicted in FIG. 8B-1, a rectangular bent region 142 is formed at flat, upper end portion 14*a* of wall 14.

Next, tray-shaped plate 202 is moved to a second press machine 400 having a lower stationary mold 410 and an upper movable mold 420. Lower stationary mold 410 includes an indentation 410*a* formed on an upper surface thereof. Upper movable mold 420 includes a projection 420*a* formed on a lower surface thereof. Indentation 410*a* of lower stationary mold 410 is shaped to fit in close contact with the upper surface (to the bottom in FIG. 8E-1 of the wall 14. Projection 420*a* of upper movable mold 420 is shaped to fit in close contact with the lower surface (to the top in FIG. 8E-1) of wall 14.

As depicted in FIG. 8E-1, tray-shaped plate 202 is placed on lower stationary mold 410, such that wall 14 is closely received in indentation 410*a* of lower stationary mold 410.

Finally, as depicted in FIG. 8F-1, wall 14 of tray-shaped plate 202 is sandwiched between lower stationary mold 410 and upper movable mold 420 by moving the upper movable mold 420 downwardly. As a result, rectangular bent region 142 formed at flat, upper end portion 14*a* of wall 14 is bent flat by molds 410 and 420.

Thus, as depicted in FIG. 8G-1, slit 141 is formed at flat upper end portion 14*a* of wall 14 of tray-shaped plate 202 along the longitudinal axis of wall 14 without producing small scraps.

(3) In a third step, the pair of tray-shaped plates 202, e.g., a first and a second plate, prepared in the second step described above, are temporarily joined to each other along the plane surfaces of flanges 13; the upper surfaces of flat, upper end portion 14*a* of corresponding walls 14; and the flat, upper surface of the corresponding tongues 203. Simultaneously, the upper end portions of cylindrical projections 17 are snugly received in the upper, end portion of the corresponding cylindrical projections 16, as shown in FIG. 7.

Figure 10:
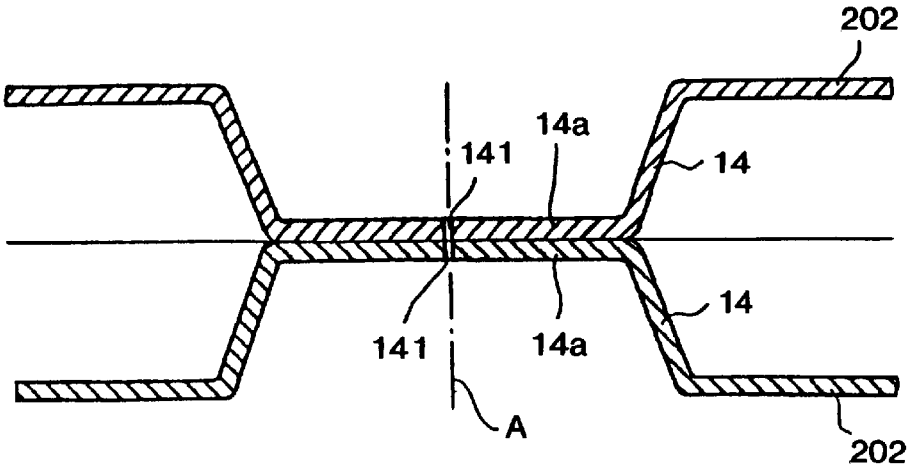
FIG. 10 is an enlarged partial view of FIG. 7.

According to this embodiment, as depicted in FIG. 10, slits 141, e.g., a first and a second slit, formed at flat, upper end portion 14*a* of corresponding walls 14, eg., a first and a second wall, of the pair of tray-shaped plates 202 oppose and are aligned with each other, for example, along the longitudinal axes of walls 14.

Then, temporarily joined tube units 201, corrugated fins 21, header pipes 230 and 240, side plates 22, and circular plate 234 are temporarily assembled with one another. In order to effectively and sufficiently maintain the mating surfaces of flanges 13, narrow walls 14, and the tongues 203, a fixing jig (not shown) may be applied to temporarily assembled evaporator 200.

After completion the process of temporarily assembling evaporator 200, temporarily assembled evaporator 200 may be transported from an assembly line to a brazing furnace, so that the elements constituting evaporator 200, such as tube units 201, cylindrical pipes 230 and 240, corrugated fins 21, side plates 22, and circular plate 234, may be fixedly connected to one another by brazing.

In this brazing process of temporarily assembled evaporator 200, the mating surfaces of the pair of plates 202, such as flanges 13; the flat, upper end surface of each of tongues 203; the upper surface of flat, upper end portion 14*a* of walls 14; and upper inner and upper outer peripheral surfaces of respective cylindrical projections 16 and 17 are brazed to one another so as to fixedly join the pair of plates 202 to each other. Before the pair of plates 202 are fixedly joined to each other by brazing, however, aluminum oxide formed on the surfaces to be mated may be removed to ensure effective brazing of the pair of plates 202. For example, the surfaces to be mated may be treated with flux to remove the aluminum oxide formed thereon.

According to a flux treatment method of this embodiment, air, in which flux powder having the mean particle size of about 20 $\mu$m is suspended, is blown onto temporarily assembled evaporator 200, so that a substantially uniform coating of the flux powder adheres to the entire exterior surface of temporarily assembled evaporator 200. Therefore, a substantially uniform coating the flux powder adheres to the exterior surface of the temporarily assembled pair of plates 202 as well.

When temporarily assembled evaporator 200 is heated in a brazing furnace during the brazing process, the flux powder adhering to the exterior surface of temporarily assembled evaporator 200 is melted before the brazing metal sheet is melted at the beginning of the brazing process. Consequently, some of the melted flux on the exterior surface of the temporarily assembled pair of plates 202 may seep into small air gaps between the mating surfaces of flanges 13, and the flat, upper end surfaces of tongues 203. Some melted flux from the exterior surface of the temporarily assembled pair of plates 202 also may seep into small air gaps created between the mating surfaces of flat, upper end portion 14*a* of walls 14 through slit 141 formed at flat, upper end portion 14*a* of walls 14 of plates 202. In addition, some melted flux from the exterior surface of the temporarily joined pair of plates 202 may seep into small radial air gaps created between an inner peripheral surface of the upper end portions of cylindrical projections 16 and an outer peripheral surface of the upper end portions of the corresponding cylindrical projections 17.

Thus, the melted flux may seep between substantially all of the mating surfaces of the temporarily assembled pair of plates 202 at the beginning of the brazing process. Therefore, substantially all of the mating surfaces of the temporarily joined pair of plates 202 to be brazed may be sufficiently and effectively treated with flux, so that aluminum oxide formed thereon is sufficiently removed before the mating surfaces of the pair of plates 202 are brazed to one another. As described above, because only the exterior surface of the temporarily joined pair of plates 202 may be coated with flux, no residual flux collects on the inner bottom surface of depression 120 and the bottom surface of depression 203*a*. Consequently, the refrigerant flow path of the automotive air conditioning refrigerant circuit is not impeded by flakes of residual flux.

According to this embodiment, because the mating surfaces of flat, upper end portion 14*a* of walls 14 of plates 202 are effectively and sufficiently brazed to each other, tube units 201 having a high inner pressure resistance are produced. Further, as described in the steps of the manufacturing process of the evaporator 200, no small scraps of material are produced when slit 141 is formed in flat, upper end portion 14*a* of wall 14 of tray-shaped plate 202. Therefore, according to this embodiment, evaporators having a high inner pressure resistance are manufactured without using expensive punches.

Moreover, in the manufacturing process of the evaporator of this embodiment, cylindrical projections 16 and 17 may be formed at the inner bottom surface of depression 120 and the bottom surface of depression 203*a* either before or after the formation of slit 141 at flat, upper end portion 14*a* of wall 14 of tray-shaped plate 202. In addition, cylindrical projections 16 and 17 may be replaced with a plurality of projections having other geometric cross-sectional shapes, e.g., square or triangular. Alternatively, cylindrical projections 16 and 17 may not be formed at the inner bottom surface of depression 120 and the bottom surface of depression 203*a*.

With reference to FIGS. 8B-2, 8G-2 and 11, a portion of the manufacturing process of evaporator 200, in accordance with a second embodiment of the present invention, is described below.

Figure 2:
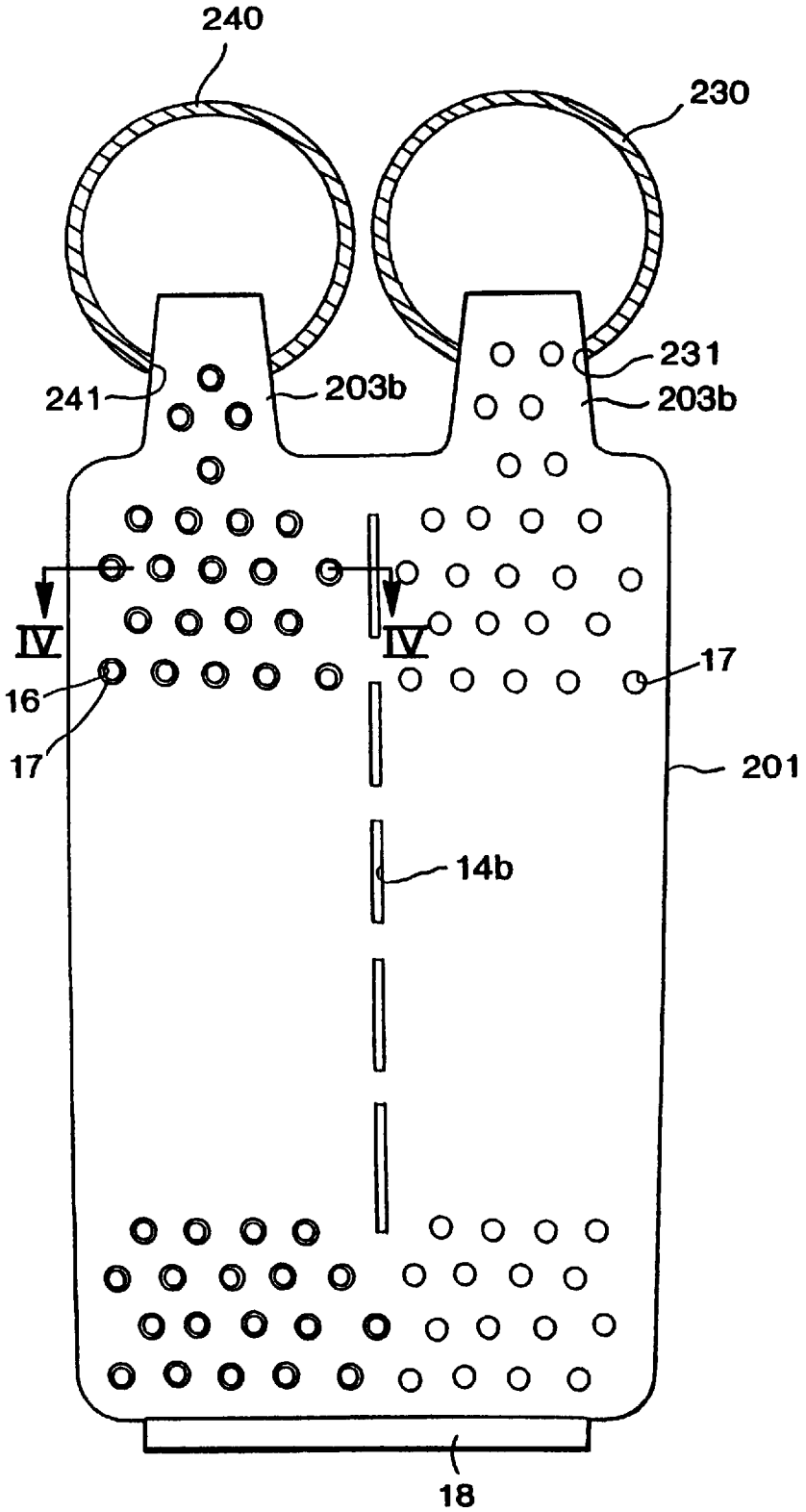
FIG. 2 (PRIOR ART)
FIG. 2 is an enlarged end view of an assembled tube unit taken along line II—II in FIG. 1.
Figure 3B:
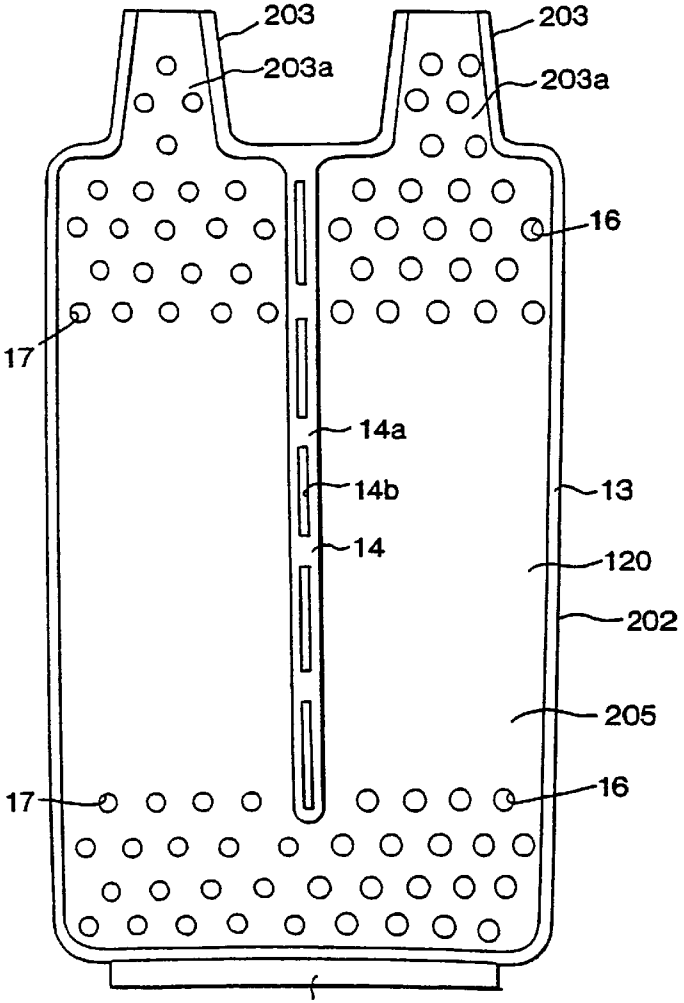
FIG. 3B (PRIOR ART)
FIGS. 3A and 3B show the tube unit of FIG. 2 unassembled.
Figure 3A:
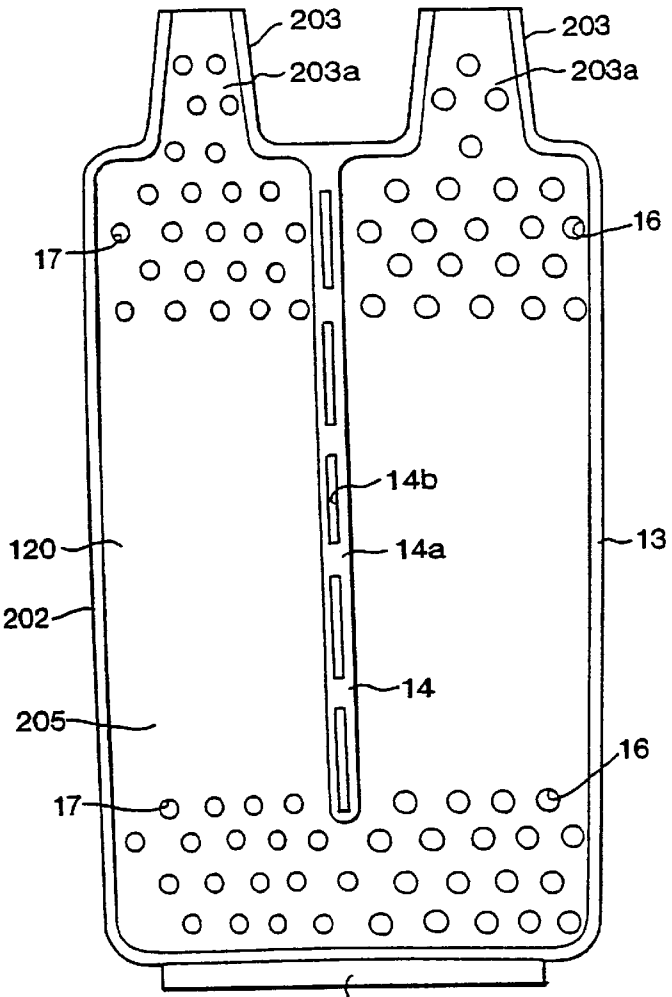
FIG. 3A (PRIOR ART)

With respect to the second step of the manufacturing process as shown in FIG. 8B-2, wall 14 of tray-shaped plate 202 is sandwiched between lower stationary mold 310 and upper movable mold 320. In this embodiment, upper movable mold 320 and lower stationary mold 310 are aligned, such that holes 320*b* and 310*b* oppose each other through flat, upper end portion 14*a* of wall 14 and such that molds 320 and 310 extend along a substantially entire length of wall 14. Upper movable mold 320 and lower stationary mold 310 are further arranged, such that one side wall (to the left in FIG. 8B-2) of hole 320*b* and one side wall (to the left in FIG. 8B-2) of hole 310*b* are offset by a predetermined distance from plane "A," which includes the longitudinal axis of wall 14 and is perpendicular to flat, upper end portion 14*a* of wall 14. Thus, as depicted in FIG. 8G-2, slit 141 is formed at flat, upper end portion 14*a* of wall 14 of tray-shaped plate 202 along a line, which is offset by the predetermined distance from the longitudinal axis of wall 14, without producing scraps.

Figure 11:
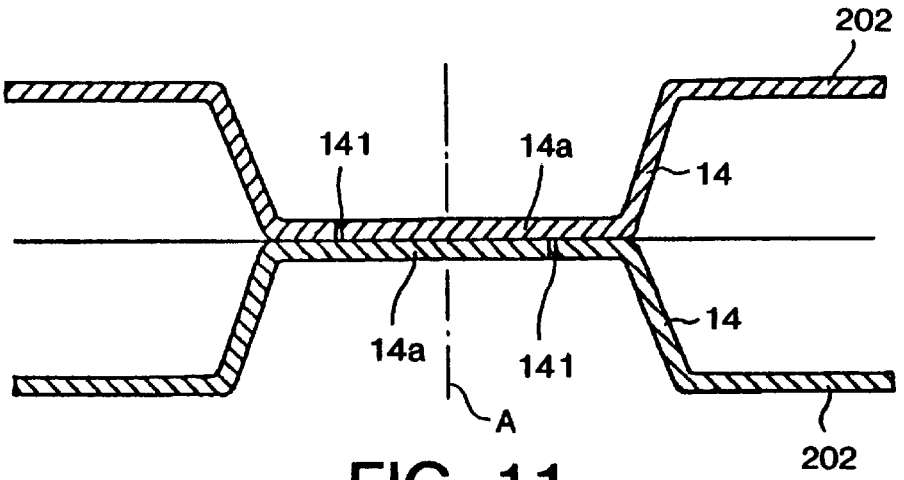
In FIG. 11, a portion of an assembled tube unit of an evaporator, in accordance with a second embodiment of the present invention.

When the pair of tray-shaped plates 202, e.g., a first and a second plates, are temporarily joined to each other, as depicted in FIG. 11, slits 141, e.g., a first and a second slit, formed at flat, upper end portion 14*a* of corresponding walls 14, eg., a first and a second wall, of the pair of tray-shaped plates 202 are offset by the predetermined distance in opposite directions from the longitudinal axes of walls 14.

In the second embodiment, steps of preparing the temporarily joined the tube unit 201 are substantially similar to those of the first embodiment, so that further explanation thereof is here omitted.

According to this second embodiment, because slit 141 formed at flat, upper end portion 14*a* of corresponding walls 14 of the pair of tray-shaped plates 202 are offset by the predetermined distance in opposite directions from the longitudinal axes of walls 14, a seeping path for the melted flux is shorter than that created in the first embodiment. Therefore, some of the melted flux applied to the exterior surface of the temporarily joined pair of plates 202 may seep more uniformly into small air gaps created between the mating surfaces of flat, upper end portion 14*a* of walls 14. As a result, the mating surfaces of flat, upper end portion 14*a* of walls 14 of plates 202 may be more effectively and sufficiently brazed to each other.

With reference to FIGS. 8F-2, 8G-3, and 12, a part of the manufacturing process of evaporator 200, in accordance with a third embodiment of the present invention, is described below.

Again, with respect to the second step of the manufacturing process as shown in FIG. 8F-2, wall 14 of tray-shaped plate 202 is loosely sandwiched between lower stationary mold 410 and upper movable mold 420 by terminating the downward movement of upper movable mold 420 at a position at which a lower surface of upper movable mold 420 is not in contact with the lower surface (toward the upper portion in FIG. 8E-1 of wall 14. As a result, a rectangular bent region 142 formed at flat, upper end portion 14*a* of wall 14 is bent back by a predetermined amount by molds 410 and 420, so that rectangular bent region 142' is newly formed at flat, upper end portion 14*a* of wall 14, and hence, a small opening 143 linked to slit 141 is simultaneously formed at flat, upper end portion 14*a* of wall 14.

Figures 3, 8F:
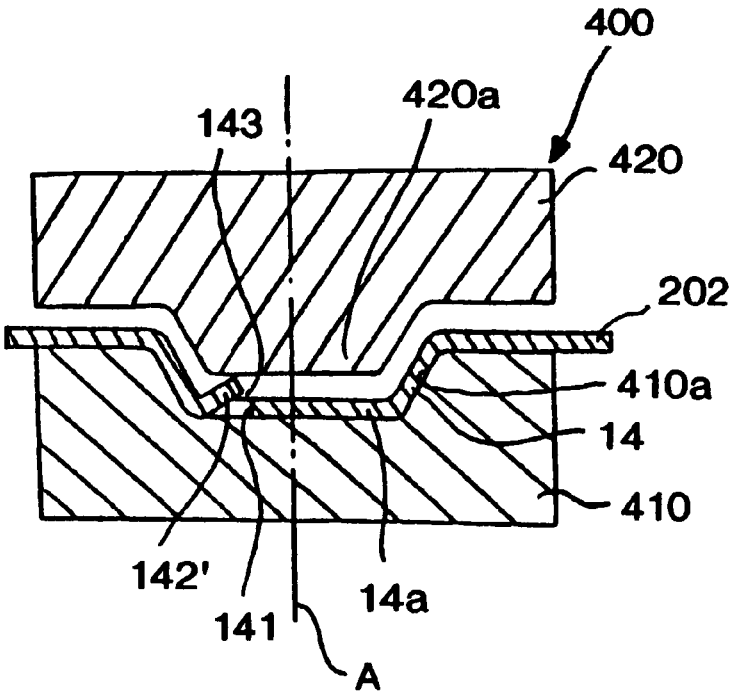
Figures 4, 8G:
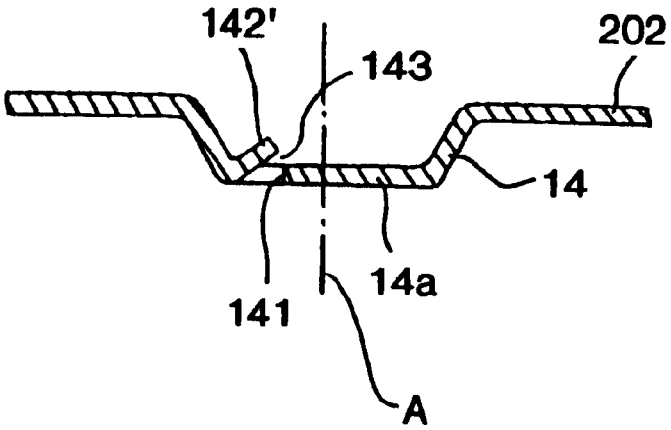

Thus, as depicted in FIG. 8G-3, rectangular bent region 142' and small opening 143 are formed at flat, upper end portion 14*a* of wall 14 of tray-shaped plate 202 along the longitudinal axis of wall 14, without producing scraps.

Figure 12:
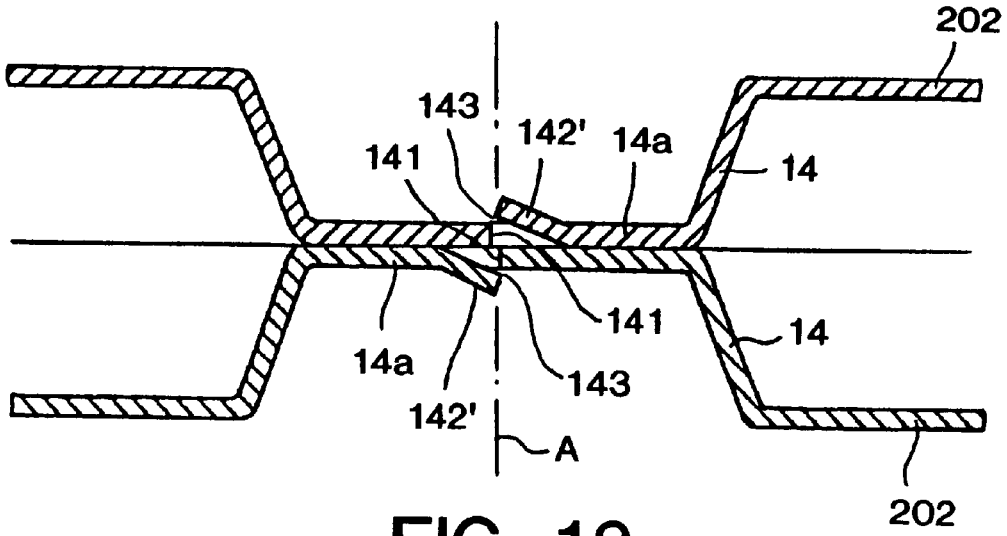
In FIG. 12, a portion of an assembled tube unit of an evaporator, in accordance with a third embodiment of the present invention.

When the pair of tray-shaped plates 202 are temporarily joined each other, as depicted in FIG. 12, rectangular being region 142' and small opening 143 formed at flat, upper end portion 14*a* of corresponding walls 14 of the pair of tray-shaped plates 202 oppose each other at plane "A," which includes the longitudinal axis of wall 14 and is perpendicular to flat, upper end portion 14*a* of wall 14.

In a third embodiment, the remaining steps of preparing temporarily joined tube unit 201 are similar to those of the first embodiment, so that further explanation thereof is here omitted.

According to a third embodiment, as a result of the formation of the rectangular bent region 142' and small opening 143, some of the melted flux for the exterior surface of the temporarily joined pair of plates 202 is effectively conducted to small air gaps between the mating surfaces of the flat upper end portion 14*a* of walls 14. Thus, the mating surfaces of flat, upper end portion 14*a* of walls 14 of the plates 202 may be more effectively and sufficiently brazed to each other.

With reference to FIGS. 8F-3, and 8G-4, and 13, a portion of the manufacturing process of evaporator 200, in accordance with a fourth embodiment of the present invention, is described below.

Once again, with respect to the second step of the manufacturing process as shown in FIG. 8F-3, tray-shaped plate 202 processed in accordance with the second embodiment is loosely sandwiched between lower stationary mold 410 and upper movable mold 420 in a manner similar to that described above with respects to the third embodiment.

Thus, as depicted in FIG. 8G-4, rectangular bent region 142' and small opening 143 are formed at flat upper end portion 14*a* of wall 14 of tray-shaped plate 202 along a line, which is offset by a predetermined distance from the longitudinal axis of wall 14, without producing small scraps.

Figure 13:
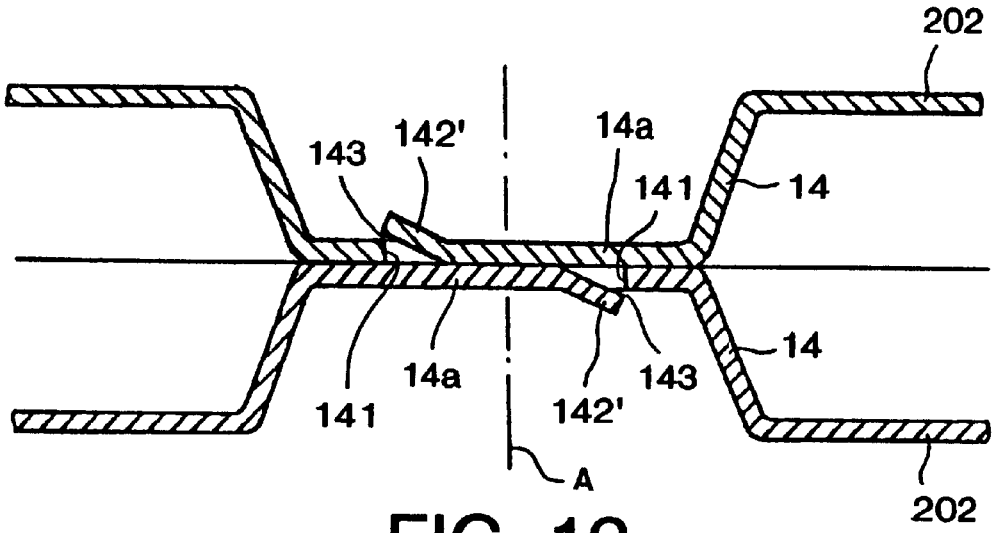
In FIG. 13, a portion of an assembled tube unit of an evaporator, in accordance with a fourth embodiment of the present invention.

When the pair of tray-shaped plates 202 are temporarily joined each other, as depicted in FIG. 13, rectangular bent region 142' and small opening 143 formed at flat, upper end portion 14*a* of corresponding walls 14 of the pair of tray-shaped plates 202 are offset by the predetermined distance in opposite directions from the longitudinal axes of walls 14.

In a fourth embodiment, temporarily joined tube unit 201 is prepared by combining steps of the second embodiment, and steps of the third embodiment, thus, further explanation thereof is here omitted.

Accordingly, in this fourth embodiment, not only the effects of the second embodiment, but also the effect of the third embodiment, are obtained. The other effects obtained by the second through fourth embodiments are similar to those described with respect to the first embodiment, so that further explanation thereof is here omitted.

This invention has been described in detail in connection with preferred embodiments. These embodiments, however, are merely exemplary, and the invention is not limited thereto. It will be understood by those skilled in the art that variations and modifications may readily be made within the scope of this invention, as defined by the following claims.

We claim:

1. A method for forming a heat exchanger, said heat exchanger including a plurality of laminated tube units, each of said tube units including a first plate and a second plate joined together to define therebetween a fluid passage and at least one fluid communication opening extending from said first and second plates and linked in fluid communication with said fluid passage, at least one conduit disposed on an upper surface of said plurality of laminated tube units, said at least one conduit including a plurality of slots for receiving said at least one fluid communication opening in said plurality of laminated tube units, said first plate including a first depression formed therein, a first peripheral flange, and a first wall having a longitudinal axis and disposed at an intermediate location therein and extending a portion of the length of said first plate, said first wall thereby defining a first side and a second side in said first plate, said first wall including a flat portion formed at an upper end thereof, said second plate including a second depression formed therein, a second flange, and a second wall having a longitudinal axis and disposed at an intermediate location therein and extending a portion of the length of said second plate, said second wall thereby defining a first side and a second side in said second plate, said second wall including a flat portion formed at an upper end thereof, the method comprising the steps of:

forming said first and second walls in each of said plates by pressing; and forming a first slit at said flat upper end portion of said first wall and a second slit at said flat upper end portion of said second wall by shearing, and offsetting said first slit in said first wall and said second slit in said second wall a distance from said longitudinal axis of each of said walls, wherein said slits extend along each of said walls' length.

2. A method for forming a heat exchanger, said heat exchanger including a plurality of laminated tube units, each of said tube units including a first plate and a second plate joined together to define therebetween a fluid passage and at least one fluid communication opening extending from said first and second plates and linked in fluid communication with said fluid passage, at least one conduit disposed on an upper surface of said plurality of laminated tube units, said at least one conduit including a plurality of slots for receiving said at least one fluid communication opening in said plurality of laminated tube units, said first plate including a first depression formed therein, a first peripheral flange, and a first wall having a longitudinal axis and disposed at an intermediate location therein and extending a portion of the length of said first plate, said first wall thereby defining a first side and a second side in said first plate, said first wall including a flat portion formed at an upper end thereof, said second plate including a second depression formed therein, a second flange, and a second wall having a longitudinal axis and disposed at an intermediate location therein and extending a portion of the length of said second plate, said second wall thereby defining a first side and a second side in said second plate, said second wall including a flat portion formed at an upper end thereof, the method comprising the steps of:

forming said first and second walls in each of said plates by pressing;

forming a first slit at said flat upper end portion of said first wall and a second slit at said flat upper end portion of said second wall by shearing, and offsetting said first slit in said first wall and said second slit in said second wall a distance from said longitudinal axis of each of said walls, wherein said slits extend along each of said walls' length;

temporarily assembling said first and second plates, so that an upper surface of said flat upper end portions of said first and second walls of said plates mate with each other;

coating an exterior surface of said tube unit with a flux; and brazing said mating surfaces of said flat upper end portion of said first and second walls of said first and second plates.

3. The method of claim 2, wherein the method further comprises the step of coating an exterior surface of said tube unit with flux.

4. The method of claim 2, wherein said flux is a flux powder having a mean particle size of about 20 $\mu$m.

5. The method of claim 1, wherein said step of forming said slits further comprises offsetting each of said slits in a common direction relative to said longitudinal axis of said slit's respective wall.

6. The method of claim 1, wherein said step of forming said slits further comprises offsetting said first slit in a first direction and offsetting said second slit in a second direction opposite to said first direction relative to said longitudinal axis of said first wall.

* * * * *